US010611146B2

(12) United States Patent
Venner et al.

(10) Patent No.: US 10,611,146 B2
(45) Date of Patent: Apr. 7, 2020

(54) METHOD OF OPERATING A DROP-ON-DEMAND JETTING DEVICE

(71) Applicant: Océ Holding B.V., Venlo (NL)

(72) Inventors: Cornelis W. M. Venner, Venlo (NL); Johannes M. M. Simons, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/026,622

(22) Filed: Jul. 3, 2018

(65) Prior Publication Data

US 2019/0016128 A1 Jan. 17, 2019

(30) Foreign Application Priority Data

Jul. 11, 2017 (EP) ..... 17180659

(51) Int. Cl.
*B41J 2/01* (2006.01)
*B41J 2/045* (2006.01)

(52) U.S. Cl.
CPC ..... *B41J 2/04588* (2013.01); *B41J 2/04536* (2013.01); *B41J 2/04573* (2013.01); *B41J 2/04581* (2013.01); *B41J 2/04586* (2013.01)

(58) Field of Classification Search
USPC ..... 347/11
See application file for complete search history.

(56) References Cited

U.S. PATENT DOCUMENTS 6,685,293 B2 * 2/2004 Junhua ..... B41J 2/04581 347/11
2010/0171778 A1 7/2010 Ozawa
2016/0067964 A1 3/2016 Hitzlsperger et al.

FOREIGN PATENT DOCUMENTS

EP 0467656 A2 1/1992
EP 0947325 A1 10/1999
EP 1023998 A2 8/2000

OTHER PUBLICATIONS

Search Report issued in European priority application 17180659.9, dated Feb. 14, 2018.

* cited by examiner

*Primary Examiner* — Lam S Nguyen
(74) *Attorney, Agent, or Firm* — Birch, Stewart, Kolasch & Birch, LLP

(57) ABSTRACT

A method of operating a drop-on demand (DOD) jetting device having a nozzle, a pressure chamber filled with a liquid and connected to the nozzle and an actuator energized by a drive signal, wherein a periodic DOD signal determines whether or not a droplet is jetted out from the nozzle in a given DOD period, and the drive signal has a waveform configured to cause the actuator to excite a pressure wave in the liquid, the method further comprising the steps of a) energizing the actuator with a waveform that has a fixed pattern and extends over a time interval that is longer than the given DOD period; and b) ignoring the DOD signal in at least the first DOD period that follows after said period for which the step a) has been performed.

6 Claims, 4 Drawing Sheets

METHOD OF OPERATING A DROP-ON-DEMAND JETTING DEVICE

BACKGROUND OF THE INVENTION

1. Field of the Invention

The invention relates to a method of operating a drop-on-demand (DOD) jetting device having a nozzle, a pressure chamber filled with a liquid and connected to the nozzle, and an actuator energized by a drive signal, wherein a periodic DOD signal determines whether or not a droplet is jetted out from the nozzle in a given DOD period, and the drive signal has a waveform configured to cause the actuator to excite a pressure wave in the liquid.

More particularly, the invention relates to a method of operating an ink jet printer and to an ink jet printer that has a circuit configured for executing the invented method.

2. Description of the Related Art

US 2016/067964 A1 discloses an example of an ink jet printer which can be operated with variable drop-on-demand frequency and, accordingly, with variable DOD period, which permits for example to adapt the length of the DOD periods to varying velocities of the relative movement of a print head and a recording medium.

When, in a given DOD period, the DOD signal requires that a droplet is jetted out from a print element that is comprised of a single nozzle, a corresponding pressure chamber and an associated actuator, the actuator is energized so as to excite a pressure wave in the liquid in the pressure chamber. The pressure wave propagates to the nozzle, where an ink droplet is jetted out onto the recording medium.

The jetting behavior, in particular the volume and the jetting speed of the droplet, depends upon the history of the print element. For example, when the print element has already been active in the preceding DOD period, a residual pressure wave is decaying in the pressure chamber and influences the shape and position of the liquid/air meniscus in the nozzle orifice when the next pressure pulse is generated for jetting out a new droplet. Then, the volume and speed of the droplet will be influenced by the instantaneous shape of the meniscus. On the other hand, when the print element has been silent in the preceding DOD period, there are no substantial pressure fluctuations in the pressure chamber and the meniscus will be in a "rest" position, and this results in a different volume and speed of the droplet.

In order to compensate for this effect, it is known to energize the actuator with a pre-fire pulse shortly before the print element is to start jetting again. Then the pre-fire pulse creates a pressure wave which is similar to the residual pressure wave that would be present in the pressure chamber when the print element had been active in the preceding period.

The pre-fire pulse and the jetting pulse which actually causes the droplet to be jetted out may be applied in the same DOD period. This, however, imposes a lower limit on the length of the DOD period and, consequently, limits the DOD frequency and the production of the printer.

As an alternative, the pre-fire pulse may be formed in the DOD period that precedes the period in which the droplet is to be jetted out. Then, however, when the DOD frequency is not constant, the print quality may be compromised by varying time delays between the time when the pre-fire pulse is generated and the time when the jetting pulse is generated.

It is an object of the invention to assure a stable and reproducible jetting behavior even at high DOD frequencies, notwithstanding the fact that the jetting behavior depends upon the condition of the meniscus which itself depends upon the history of the jetting device.

SUMMARY OF THE INVENTION

In order to achieve this object, the method according to the invention comprises the steps of:

a) energizing the actuator with a waveform that has a fixed pattern and extends over a time interval that is longer than the given DOD period; and b) ignoring the DOD signal in at least the first DOD period that follows after the period for which step a) has been performed.

Thus, it is an outstanding feature of the invention that the actuator is—at least sometimes—energized with a waveform that is so long that it does not fit into the DOD period. By energizing the actuator with such an over-long waveform, it is possible to optimize the waveform and to shape the time behavior of the pressure wave such that stable jetting conditions are obtained. If the DOD signal specifies that another droplet has to be expelled in the next DOD period, then the actuator is still controlled by the over-long waveform and will not be ready to react directly on the DOD signal for the next period. In that case, rather than aborting the over-long waveform, the DOD signal for the subsequent DOD period is simply ignored. This does however not exclude that the DOD signal for the next period influences the actuator indirectly, because the shape of the over-long waveform may be dependent on the DOD signals for two or more successive DOD periods. It turns out that, by appropriately selecting the over-long waveform, it is possible to avoid or at least mitigate a detrimental effect of skipping DOD signals for certain DOD periods, so that an overall improvement in quality is achieved.

More specific optional features of the invention are indicated in the dependent claims.

In one embodiment, the waveform may comprise a pre-fire pulse and a jetting pulse, wherein the jetting pulse follows the pre-fire pulse with a fixed and optimized time delay, so that the meniscus at the nozzle will be in a well-defined state at the time when the pressure wave generated by the jetting pulse arrives at the nozzle. The actuator will be energized with this waveform in a DOD period for which the DOD signals specify that no droplet shall be expelled in the present period but a droplet shall be expelled in the DOD period following immediately thereafter. Then, rather than triggering another jetting pulse in the subsequent DOD period, the jetting pulse that has been embedded in the waveform will cause a droplet to be jetted out at at least approximately the correct timing.

Optionally, minor errors in the jetting timing may be compensated by adapting the speed with which the droplet is jetted out. This may be accomplished by appropriately selecting the amplitude or the edge position of the waveform or certain parts of the waveform. It will be observed that the overall shape of the waveform does not necessarily have to be fixed. It is only required that the waveform has a fixed pattern in the sense that the time delay between the pre-fire pulse and the jetting pulse is fixed.

In another embodiment, the DOD signal is represented by a bit sequence in which each bit is assigned to another one of the successive DOD periods. The bit sequence is split into a sequence of groups in which each group consists of only a limited number successive bits, and a specific waveform is defined for each of these groups. When the group comprises two or more bits, the length of the waveform will be larger than a single DOD period. The waveforms associated with each of the groups are chosen in accordance with the resonance frequency and the damping behavior of the oscillating system that is constituted by actuator and the liquid in the pressure chamber, and the waveforms are fine-tuned to produce a drop generation pattern that matches the bit sequence in the DOD signal and to produce a well defined and stable state of the meniscus at the end of the last DOD period in the group. This permits to obtain a high-quality printed image while operating the jetting device at its highest possible DOD frequency.

BRIEF DESCRIPTION OF THE DRAWINGS

Embodiment examples will now be described in conjunction with the drawings wherein.

DETAILED DESCRIPTION OF EMBODIMENTS

Figure 1:
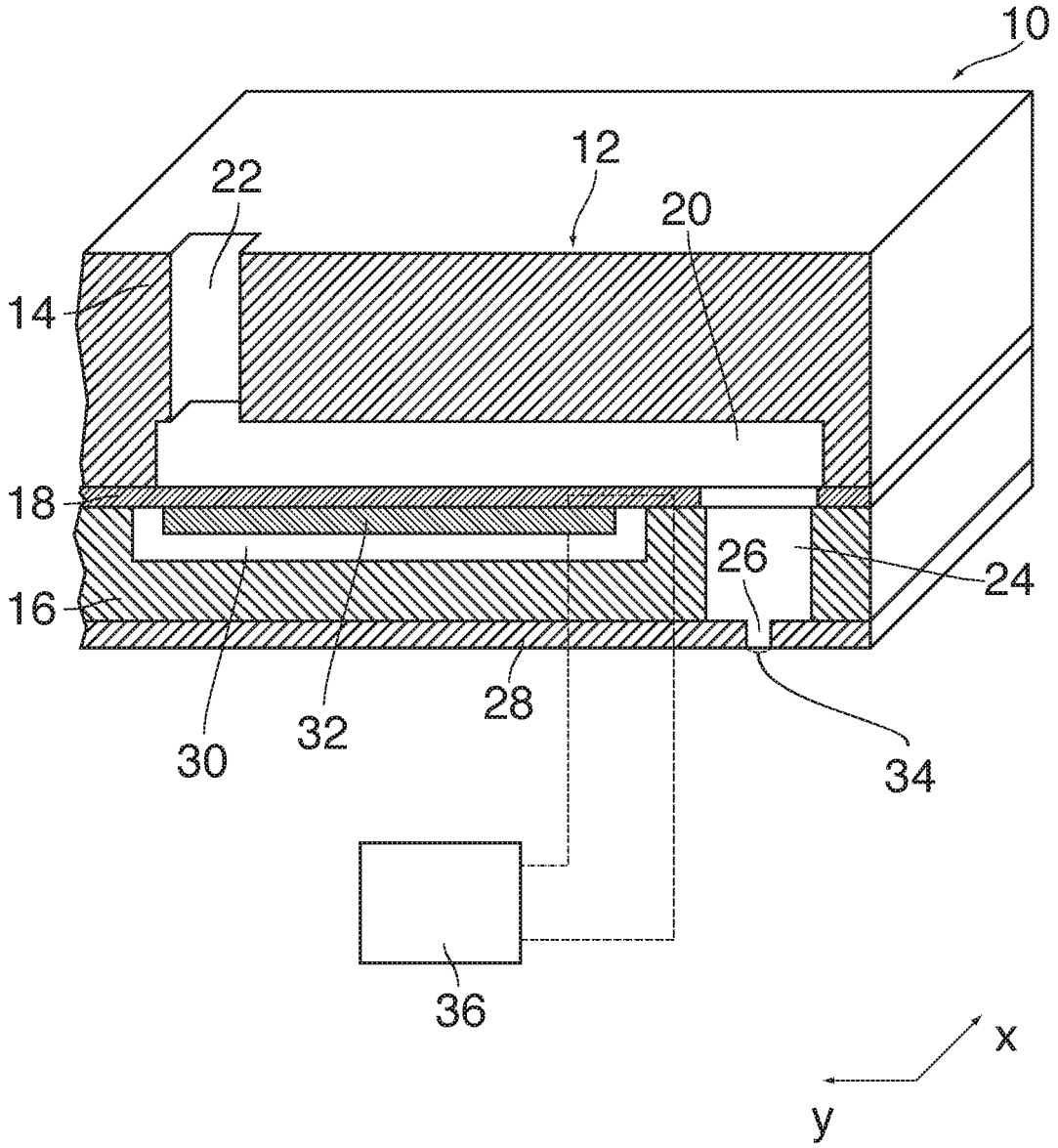
FIG. 1 is a cross-sectional view of a printing element of an ink jet printer to which the invention is applicable.

As an example of a jetting device, FIG. 1 shows a single print element 10 of an ink jet print head. A body 12 of the print head comprises a wafer 14 and a support member 16 that are bonded to opposite sides of a thin flexible membrane 18.

A recess that forms a pressure chamber 20 is formed in the face of the wafer 14 that engages the membrane 18, i.e. the bottom face in FIG. 1. The pressure chamber 20 has an essentially rectangular shape. An end portion on the left side in FIG. 1 is connected to an ink supply passage 22 that passes through the wafer 14 in thickness direction of the wafer and serves for supplying liquid ink to the pressure chamber 20.

An opposite end of the pressure chamber 20, on the right side in FIG. 1, is connected, through an opening in the membrane 18, to a chamber 24 that is formed in the support member 16 and opens out into a nozzle 26 that is formed in a nozzle plate 28 constituting the bottom face of the support member 16.

Adjacent to the membrane 18 and separated from the pressure chamber 20, the support member 16 forms another cavity 30 accommodating a piezoelectric actuator 32 that is bonded to the membrane 18.

An ink supply system which has not been shown here keeps the pressure of the liquid ink in the pressure chamber slightly below the atmospheric pressure, e.g. at a relative pressure of −1000 Pa, so as to prevent the ink from leaking out through the nozzle 26. In the nozzle orifice, the liquid ink forms a meniscus 34.

The piezoelectric actuator 32 has electrodes that are connected to an electronic controller 36 which controls a voltage to be applied to the actuator.

When an ink droplet is to be expelled from the nozzle 26, the controller 36 outputs a voltage pulse to the actuator 32. This voltage pulse causes the actuator to deform in a bending mode. More specifically, the actuator 32 is caused to flex downward, so that the membrane 18 which is bonded to the actuator 32 will also flex downward, thereby to increase the volume of the pressure chamber 20. As a consequence, additional ink will be sucked-in via the supply passage 22. Then, when the voltage pulse falls off again, the membrane 18 will flex back into the original state, so that a positive acoustic pressure wave is generated in the liquid ink in the pressure chamber 20. This pressure wave propagates to the nozzle 26 and causes an ink droplet to be expelled.

The acoustic wave that has caused a droplet to be expelled from the nozzle 26 will be reflected (with phase reversal) at the open nozzle and will propagate back into the pressure chamber 20. Consequently, even after the droplet has been expelled, a gradually decaying acoustic pressure wave is still present in the pressure chamber 20, and the corresponding pressure fluctuations exert a bending strain on the membrane 18 and the actuator 30. This mechanical strain on the piezoelectric transducer leads to a change in the impedance of the actuator, and optionally this change may be measured within the controller 36.

The single printing element that has been shown in cross-section in FIG. 1 is one of a plurality of printing elements the nozzles 26 of which are aligned in row that extends in a direction x in FIG. 1. The actuators 32 of these printing elements are all controlled by the controller 36 so that, while the print head scans a sheet of a recording medium in a direction y, the ink droplets ejected by the nozzles 26 form a pixel pattern in accordance with an image to be printed.

Figure 2:
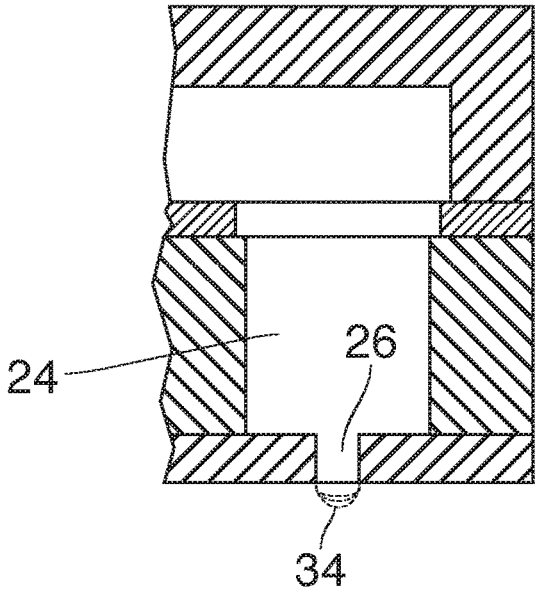
FIG. 2 is an enlarged view of a meniscus at a nozzle of the printing element shown in FIG. 1.

FIG. 2 is an enlarged view of a part of the printing element shown in FIG. 1 and symbolically illustrates the effect that the pressure fluctuations in the pressure chamber 20 have on the meniscus 34 at the nozzle 26. Conceivably, the instantaneous shape of the meniscus 34 will affect the jetting behaviour, in particular the volume of the droplet being formed and the speed with which the droplet is jetted out. In order to obtain a high print quality, it is desired that the volume of the droplets is constant and the jetting speed is also constant so that, in view of the relative movement of the print head and the recording medium, the droplets will hit the recording medium at the correct positions.

Figure 3:
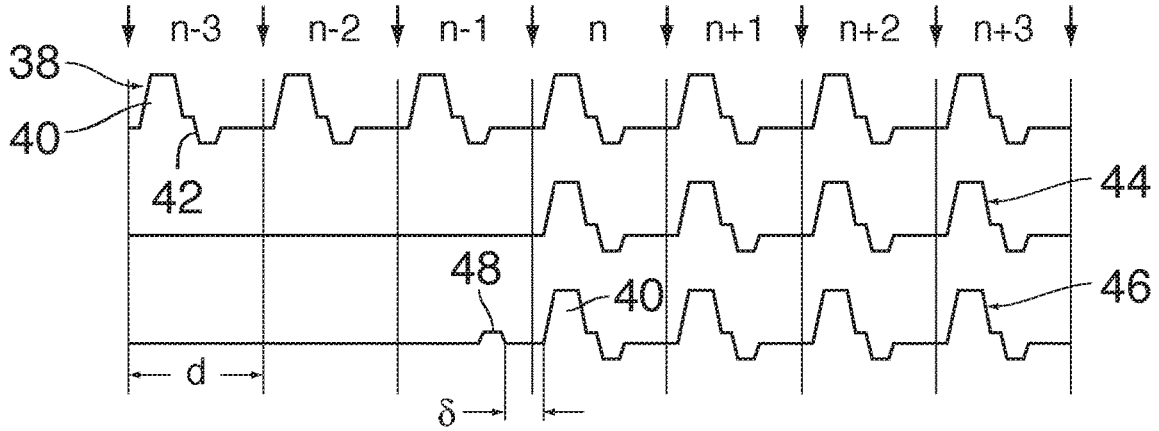
FIG. 3 is a time diagram showing waveforms for energizing an actuator of the printing element in accordance with a conventional method.

FIG. 3 is a time diagram showing a sequence of drop-on-demand (DOD) periods in which, depending upon the image content to be printed, a droplet is either jetted out or not jetted out. The DOD periods are numbered as n−3, n−2, n−1, n, n+1, n+2, n+3. The start of each DOD period is marked by an arrow.

A curve 38 illustrates, as a function of time, a voltage with which the actuator 32 is energized in a scenario in which a droplet is to be expelled in each of the successive DOD periods. In each DOD period, the voltage signal comprises a jetting pulse 40, which causes a droplet to be formed and jetted out, and a subsequent quench pulse 42 which serves to attenuate a residual pressure wave in the pressure chamber 20 after the droplet has been expelled. Nevertheless, some pressure fluctuations will still be present in the pressure chamber 20 and at the nozzle 26 at the time when the next jetting pulse is generated in the subsequent DOD period. However, since the DOD periods have (at least approximately) the same length d and the voltage signal is synchronized with the DOD periods, the condition of the meniscus 34 will always be essentially the same at the time when a new droplet is being expelled, so that the jetting behavior is stable.

A curve 44 in FIG. 3 illustrates a case where the print element has been silent in the DOD periods n−3, n−2 and n−1, and starts jetting in the period n and the subsequent periods. In this case, in the DOD period n, the meniscus 34 will not be affected by any substantial pressure fluctuations at the time when the droplet is formed. Consequently, the jetting behavior may be different from the behavior that has been observed in the situation illustrated by the curve 38, and the differences in the condition of the meniscus 34 may give raise to undesired artefacts in the printed image.

In order to avoid or mitigate such artefacts, it is known to control the voltage applied to the actuator 32 as illustrated by a curve 46 in FIG. 3. In the DOD period n−1, which is the last one in which the print element is silent, the actuator is energized with a pre-fire pulse 48 the amplitude of which is so small that no droplet will be expelled in the period n−1. The purpose of the pre-fire pulse 48 is to create pressure fluctuations which are similar to the residual pressure fluctuations in the case that the droplet has been expelled, so that, when the next droplet is jetted out in the next period n, the condition of the meniscus 34 will be essentially the same as in the case where the print element is jetting constantly. The timing of the pre-fire pulse is determined by the start of the period n−1. In order to "simulate" the residual pressure fluctuations in the right way, it is essential that the time delay δ between the pre-fire pulse 48 and the next jetting pulse 40 is controlled with high precision.

A problem may arise, however, when the length of the DOD periods is not constant because, for example, the print head is moved relative to the recording medium with varying speed and the drop generation frequency (DOD frequency) has to be adapted to the varying scanning speed.

Figure 4:
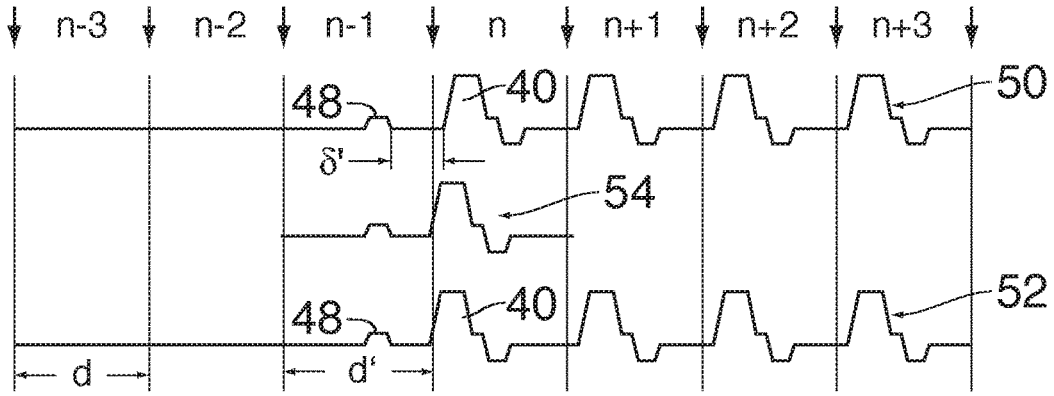
FIG. 4 is a time diagram showing waveforms employed in a method according to the invention.

FIG. 4 illustrates a case where the start of the DOD period n has been delayed, so that the length d' of the preceding period n−1 is larger than the length d of the other DOD periods. The upper curve 50 in FIG. 4 illustrates the control method that has been described above in conjunction with the curve 46. The pre-fire pulse 48 in the period n−1 has a fixed timing relative to the start of the DOD period n−1. The jetting pulses 40 in the subsequent DOD periods n, n+1, etc. have fixed timings relative to the start of the respective DOD periods. Thus, due to the increased length of the DOD period n−1, a time delay δ' between the pre-fire pulse 48 and the next jetting pulse 40 is larger than the required delay time δ. It will understood that the pressure fluctuation created by the pre-fire pulse 48 has the form of a relatively sharp pressure pulse, so that the condition of the meniscus 34 depends critically on even minor changes in the delay time, so that unwanted artefacts may be produced.

In order to avoid this drawback, in the method according to the invention, the voltage applied to the actuator is controlled in accordance with the curve 52 in FIG. 4. According to this curve, the pre-fire pulse 48 in the period n−1 and the jetting pulse 40 in the period n are integrated in a continuous waveform 54 which has been shown separately in FIG. 4. This waveform 54 has a fixed pattern, i.e. at least the timings and durations of the pre-fire pulse 48, the jetting pulse 40 and the quench pulse 42 are fixed relative to the start of the DOD period n−1. It is observed that the waveform 54 is longer than the length d' of the DOD period n−1. Actually, the waveform 54 extends over the entire time interval spanning the DOD periods n−1 and n. Thus, when the period n starts and, normally, another jetting pulse should be triggered, the actuator 32 is still controlled by the waveform 54, so that no new jetting pulse can be triggered. Instead, the function of the jetting pulse is fulfilled by the pulse that is integrated in the waveform 54 and is triggered already at the start of the preceding DOD period n−1. This has the favorable consequence that the time delay between the pre-fire pulse and the jetting pulse is reliably fixed to the optimal value δ, which assures a stable condition of the meniscus 34.

Comparing the curves 52 and 50, it can be seen that, in the curve 52, the jetting pulse 40 is advanced relative to the corresponding jetting pulse 40 in the curve 50. As a consequence, the jetting pulses 40 in the DOD periods n and n+1 are separated by a larger time interval than the jetting pulses in the other periods n+2, n+3, etc. This may result in a minor aberration of the ink dot that is printed in the period n relative to its neighbor printed in the period n+1. In general, however, the visible effect of the aberration is less significant than the artefacts that would be produced by changes in the condition of the meniscus 34. Optionally, the aberration may be reduced by modulating the waveform 54 such that the time advance of the jetting pulse 40 in the period n is at least partly compensated by a slightly smaller jetting velocity of the droplet. Similarly, the waveform 54 may be modulated in order to optimize the volume of the droplet.

In principle, the increased time interval between the jetting pulses in the periods n and n+1 (curve 52) may result in a change in the condition of the meniscus 34. However, since a droplet has actually been jetted out in the period n, the residual pressure fluctuations arriving at the nozzle 26 will in general have a different shape than the sharp pressure pulse created by the pre-fire pulse 48 and will rather take the form of a pulse that has been widened considerably on the time axis. Consequently, at the time when the droplet is generated in the period n+1, the condition of the meniscus 34 will be less sensitive to changes in the time interval that separates the jetting pulses.

Another embodiment of the method according to the invention will now be explained in conjunction with FIGS. 5 to 8.

In this embodiment, it shall be assumed that the DOD frequency and hence the length of the DOD periods is constant (although an extension to varying DOD frequencies is possible). In the example shown the DOD frequency is 100 kHz, so that an individual DOD period has the length d of 10 μs.

Figure 5:
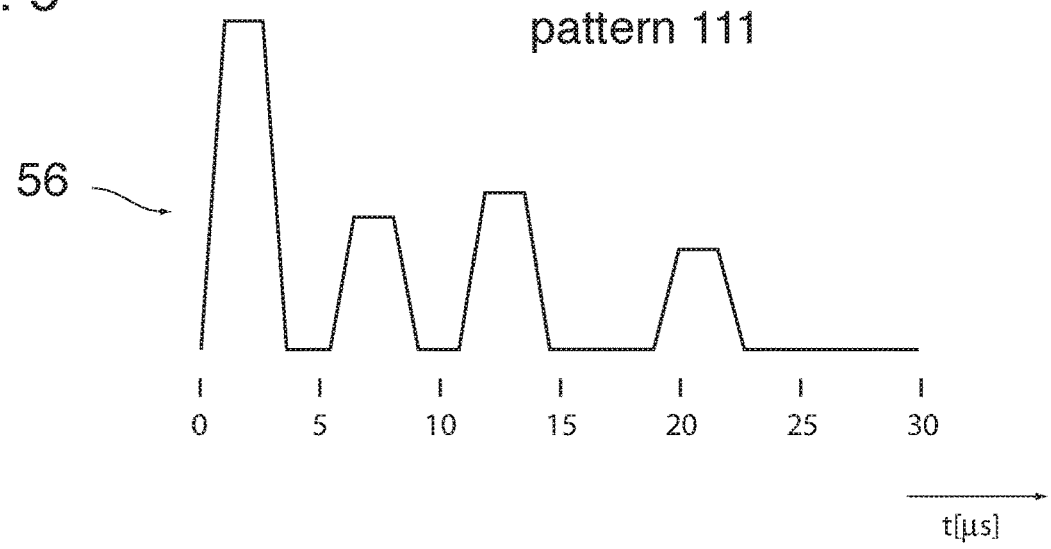
FIGS. 5 to 7 show waveforms employed in a method according to another embodiment of the invention.

FIG. 5 shows a waveform 56 that extends over a time interval of 30 μs, i.e. three full DOD periods. The waveform 56 contains a sequence of four pulses with different amplitudes and non-regular timings and has been tuned to the oscillation properties of the oscillating system constituted by the liquid ink in the pressure chamber 20, the chamber 24 and the nozzle 26 and the properties of the membrane 18 and the actuator 32 such that three droplets with identical volumes are expelled from the nozzle 26 with identical jetting speeds with time intervals of 10 μs (one DOD period) from droplet to droplet. The concatenation of the four pulses preserves of their relative timing, independent of the DOD frequency. This results in a consistent droplet forming and a decoupling of the oscillation properties of the system and the (varying) DOD frequency. The pixel pattern formed on the recording medium corresponds to three successive black pixels represented by a binary number or pattern "111", wherein each "1" stands for a black pixel and a "0" would stand for a white pixel. Alternatively, the waveform may be designed to make the jetting speeds of the various droplets slightly different, such that they assemble before reaching the medium. In both instances, the waveform is much longer than the individual DOD period.

Figure 6:
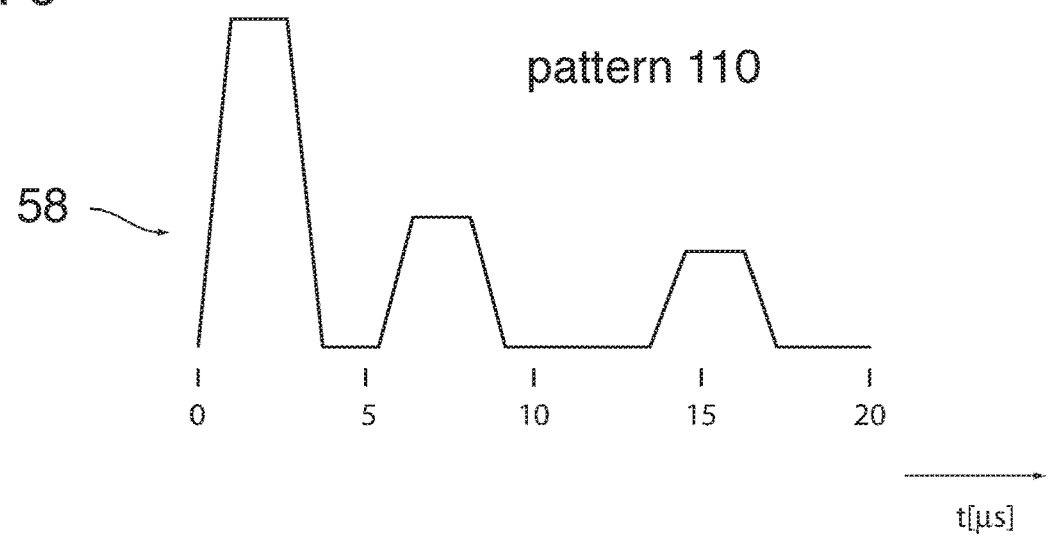

Similarly, FIG. 6 shows a waveform 58 for printing a pattern "110", i.e. two black pixels followed by a white pixel. The waveform 58 has a duration of 20 μs (two full DOD periods) and comprises three pulses with different amplitudes.

Figure 7:
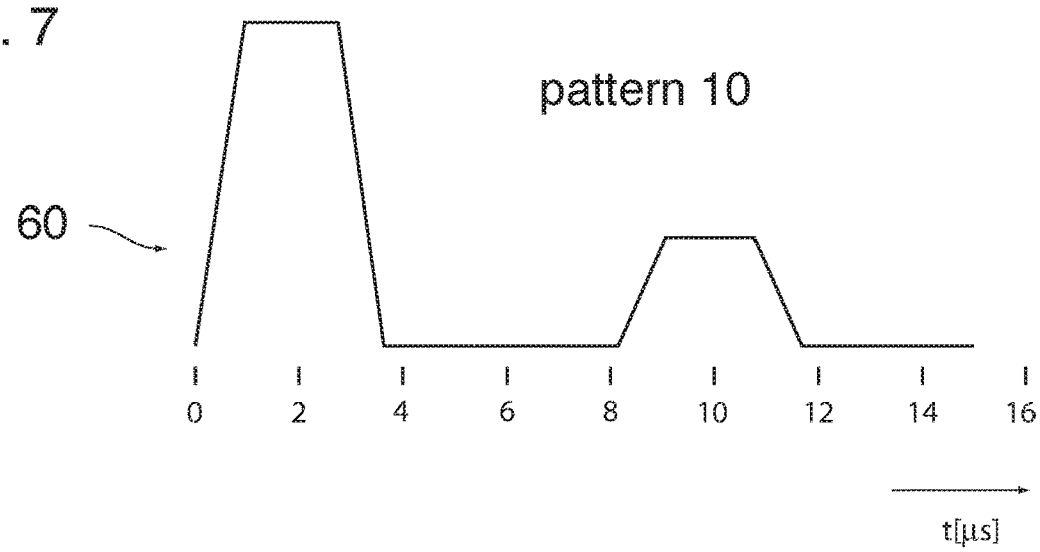

FIG. 7 shows a waveform 60 for printing a pattern "10", i.e. one black pixel followed by a white pixel. This waveform has a duration of 15 μs and contains only two pulses with different amplitudes.

If a DOD signal is considered as a bit sequence wherein each "1" stands for a black pixel and each "0" stands for a white pixel, then any DOD signal can be split into a sequence of groups with 1 to 3 digits in which the pixel pattern is either "111", "110", "10" or "0". Thus, the three waveforms 56, 58 and 60 shown in FIGS. 5 to 7 and the "trivial" zero-waveform (no jetting pulse at all) are sufficient for printing an arbitrary image content.

Figure 8:
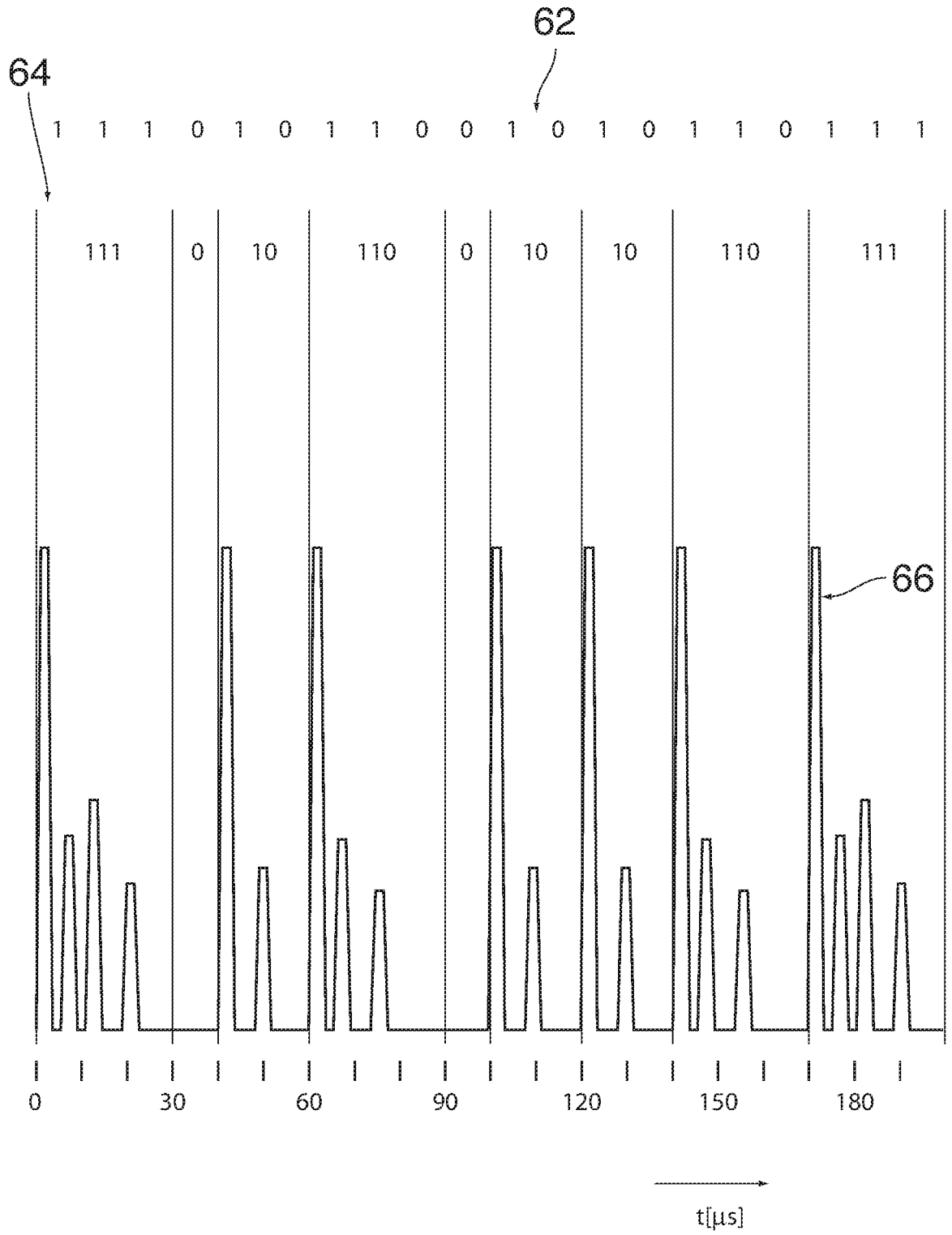
FIG. 8 shows a DOD signal in the form of a bit sequence and illustrates how the bit sequence is translated into the waveforms shown in FIGS. 5 to 7.

FIG. 8 shows an example of a DOD signal 62 in the form of a bit sequence "11101011001010110111". FIG. 8 further shows how this DOD signal can be split into a sequence 64 of groups each of which has one of the pixel patterns "111", "110", "10" or "0".

The curve 66 in FIG. 8 shows the voltage to be applied to the actuator 32 as a function of time t. The curve 66 is obtained by translating each pattern into its corresponding waveform and concatenating the waveforms in accordance with the sequence 64 of the groups.

The waveforms shown in FIGS. 5 to 7 have been designed such that they not only provide the desired dot patterns but also have the property that at the end of the last DOD period over which the waveform extends, no substantial pressure fluctuations are present at the nozzle 26 so that the meniscus 34 is in the same condition as it would be in absence of any energizing pulses. Thus, whenever a new waveform begins, the meniscus 34 will be in a stable, well defined state, so that a stable jetting behavior can be obtained.

Since it is sufficient to provide only three waveforms for the different patterns, it is possible to optimize the waveforms for the given physical system of the print element, e.g. by means of experiments, in order to fulfill the requirements set out above.

The invented method is preferably embedded in an electronic circuit, such as an application specific integrated circuit (ASIC), that is designed for operating a drop-on demand (DOD) jetting device. This enables the fast switching behaviour that is required for the method. These circuits are used in various types of ink jet printers.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A method of operating a drop-on demand (DOD) jetting device having a nozzle, a pressure chamber filled with a liquid and connected to the nozzle, and an actuator energized by a drive signal, wherein a periodic DOD signal determines whether or not a droplet is jetted out from the nozzle in a given DOD period, and the drive signal has a waveform configured to cause the actuator to excite a pressure wave in the liquid, the method comprising the steps of:

a) energizing the actuator with a waveform that extends over a time interval that is longer than the given DOD period, wherein the waveform comprises at least a prefire pulse and a jetting pulse; and b) ignoring the DOD signal in at least the first DOD period that follows after said period for which the step a) has been performed, wherein the given DOD period is a DOD period for which the DOD signal specifies that no droplet shall be jetted out, and the given DOD period is immediately followed with said at least first DOD period for which the DOD signal specifies that a droplet shall be jetted out, and wherein the prefire pulse and the jetting pulse of the waveform each have a timing and a duration that are always fixed relative to a start point of the given DOD period no matter whether a length of the given DOD period is larger than a length of said at least first DOD period or not.

2. The method according to claim 1, wherein said DOD periods have varying lengths.

3. The method according to claim 1, wherein the DOD signal is represented by a bit sequence in which each bit is assigned to another one of the successive DOD periods and the value of the bit specifies whether or not a droplet is jetted out, the method comprising a step of splitting the bit sequence into a sequence of groups in which each group has a number of digits not larger than a given maximum number, so that the groups can be classified into a finite number of different bit patterns, a different waveform is assigned to each of the bit patterns, and the actuator is energized with a drive signal obtained by concatenating the waveforms in the order specified by the sequence of groups.

4. The method according to claim 3, wherein the maximum number of digits in a group is three, and the bit patterns are "111", "110", "10" and "0".

5. An electronic circuit for operating a drop-on demand (DOD) jetting device configured to execute the method according to claim 1.

6. An ink jet printer comprising a drop-on demand (DOD) jetting device and an electronic circuit according to claim 5.

* * * * *